US007872431B2

(12) United States Patent
Chao

(10) Patent No.: US 7,872,431 B2
(45) **Date of Patent: *Jan. 18, 2011**

(54) DIGITAL CONTROLLED MULTI-LIGHT DRIVING APPARATUS

(75) Inventor: Yuan-Jen Chao, Kaohsiung (TW)

(73) Assignee: Gigno Technology Co., Ltd., Taipei (TW)

( * ) Notice: Subject to any disclaimer, the term of this patent is extended or adjusted under 35 U.S.C. 154(b) by 270 days.

This patent is subject to a terminal disclaimer.

(21) Appl. No.: 12/116,112

(22) Filed: May 6, 2008

(65) Prior Publication Data

US 2008/0258634 A1 Oct. 23, 2008

Related U.S. Application Data

(63) Continuation-in-part of application No. 10/715,414, filed on Nov. 19, 2003, now Pat. No. 7,388,570.

(30) Foreign Application Priority Data

Nov. 20, 2002 (TW) ..... 91218715 A

(51) Int. Cl.
*H05B 37/02* (2006.01)

(52) U.S. Cl. ..... 315/307; 315/297; 315/312

(58) Field of Classification Search ..... 315/224, 315/247, 291, 294, 297, 307–308, 312; 345/102
See application file for complete search history.

(56) References Cited

U.S. PATENT DOCUMENTS 4,529,914 A 7/1985 Kaneda et al.
5,272,327 A 12/1993 Mitchell et al.
5,461,397 A 10/1995 Zhang et al.
5,754,159 A 5/1998 Wood et al.

(Continued)

*Primary Examiner*—Douglas W Owens
*Assistant Examiner*—Tung X Le
(74) *Attorney, Agent, or Firm*—Birch, Stewart, Kolasch & Birch, LLP

(57) ABSTRACT

A digital controlled multi-light driving apparatus of the invention is for driving and controlling at least one AC-driven light and at least one DC-driven light. The digital controlled multi-light driving apparatus includes at least one first oscillation step-up circuit for driving the AC-driven light, at least one second oscillation step-up circuit for driving the DC-driven light; and a digital control circuit. The digital control circuit has a digital switching signal generating circuit and a multiplex feedback-control calculating circuit. The digital switching signal generating circuit connects to each of the first oscillation step-up circuit and the second oscillation step-up circuit and generates a first set of digital switching signals and a second digital switching signal respectively to the first oscillation step-up circuit and the second oscillation step-up circuit. The multiplex feedback-control calculating circuit has a control-calculating unit and an A/D converting unit. The control-calculating unit controls the digital switching signal generating circuit, and controls a phase and a duty cycle of one of the first set of the digital switching signals and the second digital switching signal generated by the digital switching signal generating circuit according to digital feedback signals from the A/D converting unit. The A/D converting unit converts feedback signals from the AC-driven light and the DC-driven light into the digital feedback signals, respectively. The first oscillation step-up circuit and the second oscillation step-up circuit are controlled according to the first set of digital switching signals and the second digital switching signal, respectively.

24 Claims, 9 Drawing Sheets

U.S. PATENT DOCUMENTS 5,818,172 A 10/1998 Lee et al.
5,854,617 A 12/1998 Lee et al.
5,892,336 A 4/1999 Lin et al.
6,060,843 A * 5/2000 Primisser et al. ..... 315/291
6,069,449 A 5/2000 Murakami et al.
6,075,325 A 6/2000 Kouno et al.
6,104,146 A 8/2000 Chou et al.
6,201,352 B1 3/2001 Ge et al.
6,243,067 B1 6/2001 Noguchi et al.
6,243,068 B1 6/2001 Evanicky et al.
6,420,839 B1 7/2002 Chiang et al.
6,448,955 B1 9/2002 Evanicky et al.
6,496,236 B1 12/2002 Cole et al.
6,618,031 B1 * 9/2003 Bohn et al. ..... 345/83
6,856,519 B2 2/2005 Lin et al.
6,947,024 B2 9/2005 Lee et al.
6,961,044 B2 11/2005 Woo et al.
6,963,175 B2 * 11/2005 Archenhold et al. ..... 315/291
7,388,570 B2 * 6/2008 Chao ..... 345/102
2002/0140538 A1 10/2002 Yer et al.
2003/0057886 A1 * 3/2003 Lys et al. ..... 315/291
2003/0122771 A1 7/2003 Sumiyoshi et al.
2004/0183469 A1 * 9/2004 Lin et al. ..... 315/247

* cited by examiner

DIGITAL CONTROLLED MULTI-LIGHT DRIVING APPARATUS

CROSS REFERENCE TO RELATED APPLICATIONS

This Non-provisional application is a continuation-in-part of U.S. application number Ser. No. 10/715,414, filed on Nov. 19, 2003, which claims the priority under 35 U.S.C. §119(a) on Patent Application No(s). 091218715 filed in Taiwan, Republic of China on Nov. 20, 2002.

BACKGROUND OF THE INVENTION

1. Field of Invention

The invention relates to a light driving apparatus and, in particular, to a digital controlled multi-light driving apparatus for a large size flat panel display or an illumination device.

2. Related Art

Flat panel displays have become increasingly popular in recent years, with liquid crystal displays (LCDs) garnering the most widespread acceptance. Conventional LCDs are typically employed as personal computer monitors and have a screen size of 15" or less. As manufacturing technology has developed, a variety of display sizes have come to be employed for different purposes, including use as TV displays. When employed for this purpose, a flat panel LCD with a screen size of 30" or larger is desirable. Accordingly, all LCD of this size requires a greater number of lights to provide adequate brightness. For example, an LCD with a screen size of 40" may require up to 30 lights.

When the number of lights is increased, however, an accompanying problem of poor brightness uniformity between lights arises. In addition, the number of light driving apparatuses for driving the lights is also increased. For example, regarding the conventional light driving apparatus, usually only two cold cathode fluorescent lamps (CCFLs) can be driven at the same time by one transformer. Thus, for an LCD with a large screen size requiring increased number of lights, the number of required light driving apparatuses is also increased, and manufacturing costs thereof increase as a result.

As previously mentioned, the conventional LCD typically employs CCFLs as backlights thereof. To induce the CCFL or CCFLs to emit light, a light driving apparatus with an inverter is typically used. Referring to FIG. 1, a conventional tight driving apparatus 8 mainly includes a current adjusting circuit 81, an oscillation step-up circuit 82, a detecting circuit 83, and a feedback control circuit 84.

The current adjusting circuit 81 is controlled by the feedback control circuit 84 and properly adjusts an external DC source, which is then input to the oscillation step-up circuit 82. The oscillation step-up circuit 82 converts the input DC source into an AC signal and amplifies the AC signal. The amplified AC signal is then provided to the CCFL 9, which serves as the light, so that the CCFL 9 can then emit light. Furthermore, the detecting circuit 83 detects a feedback signal, such as a current signal or a voltage signal, from one end of the CCFL 9. The feedback signal is then transmitted to the feedback control circuit 84. The feedback control circuit 84 controls the current adjusting circuit 81 according to the feedback signal, so that the current adjusting circuit 81 can output a suitable current level. It should be noted that the conventional feedback control circuit 84 is an analog feedback control circuit.

When the number of lights is increased, the number of required light driving apparatuses 8 is increased accordingly.

In an LCD with a large screen size, a plurality of circuits, each of which includes the current adjusting circuit 81, oscillation step-up circuit 82, detecting circuit 83 and feedback control circuit 84, are necessary at the same time. Since the lights are driven by different driving apparatuses 8, which are independent from one another, the brightness uniformity adjustment or phase matching between lights cannot be efficiently achieved, resulting in poor display quality.

Therefore, it is an important subjective to prevent the above-mentioned problems, so as to improve the quality of an LCD with a large screen size and reduce manufacturing costs. In addition, it is also an important subjective to improve the illumination efficiency.

SUMMARY OF THE INVENTION

In view of the above-mentioned problems, an objective of the invention is to provide a digital controlled multi-light driving apparatus, which is easily manufactured and can control the phases and brightness of numerous lights.

To achieve the above-mentioned objective, a digital controlled multi-light driving apparatus of the invention is for driving and controlling at least one AC-driven light and at least one DC-driven light. The digital controlled multi-light driving apparatus includes at least one first oscillation step-up circuit for driving the AC-driven light at least one second oscillation step-up circuit for driving the DC-driven light; and a digital control circuit. The digital control circuit has a digital switching signal generating circuit and a multiplex feedback-control calculating circuit. The digital switching signal generating circuit connects to each of the first oscillation step-up circuit and the second oscillation step-up circuit and generates a first set of digital switching signals and a second digital switching signal respectively to the first oscillation step-up circuit and the second oscillation step-up circuit. The multiplex feedback-control calculating circuit has a control-calculating unit and an A/D converting unit. The control-calculating unit controls the digital switching signal generating circuit, and controls a phase and a duty cycle of one of the first set of the digital switching signals and the second digital switching signal generated by the digital switching signal generating circuit according to digital feedback signals from the A/D converting unit. The A/D converting unit converts feedback signals from the AC-driven light and the DC-driven light into the digital feedback signals, respectively. The first oscillation step-up circuit and the second oscillation step-up circuit are controlled according to the first set of digital switching signals and the second digital switching signal, respectively.

To achieve the above-mentioned objective, a digital controlled multi-light driving apparatus of the invention is for driving and controlling a plurality of DC-driven lights. The digital controlled multi-light driving apparatus includes a plurality of at of oscillation step-up circuits for driving the DC-driven lights; and a digital control circuit. The digital control circuit has a digital switching signal generating circuit and a multiplex feedback-control calculating circuit. The digital switching signal generating circuit connects to each of the oscillation step-up circuits, and generates digital switching signals respectively to the DC oscillation step-up circuits. The multiplex feedback-control calculating circuit has a control-calculating unit and an A/D converting unit. The control-calculating unit controls the digital switching signal generating circuit, and controls a phase and a duty cycle of each digital switching signals generated by the digital switching signal generating circuit according to digital feedback signals from the A/D converting unit. The A/D converting unit converts feedback signals from the DC-driven light into the digital feedback signals, respectively. The oscillation step-up circuits are controlled according to the digital switching signals, respectively.

To achieve the above-mentioned objective, a digital control circuit of the invention is for controlling a plurality of light loads. The light loads have at least one AC-driven light, at least one DC-driven light, at least one first oscillation step-up circuit for driving the AC-driven light, and at least one second oscillation step-up circuit for driving the DC-driven light. The digital control circuit includes a digital switching signal generating circuit and a multiplex feedback-control calculating circuit. The digital switching signal generating circuit connects to each of the first oscillation step-up circuit and the second oscillation step-up circuit, and generates a first set of digital switching signals and a second digital switching signal respectively to the first oscillation step-up circuit and the second oscillation step-up circuit. The multiplex feedback-control calculating circuit has a control-calculating unit and an A/D converting unit. The control-calculating unit controls the digital switching signal generating circuit, and controls a phase and a duty cycle of one of the first set of the digital switching signals and the second digital switching signal generated by the digital switching signal generating circuit according to digital feedback signals from the A/D converting unit. The A/D converting unit converts feedback signals from the AC-driven light and the DC-driven light into the digital feedback signals, respectively. The first oscillation step-up circuit and the second oscillation step-up circuit are controlled according to the first set of digital switching signals and the second digital switching signal, respectively.

To achieve the above-mentioned objective, a digital control circuit of the invention is for controlling a plurality of light loads having a plurality of DC-driven lights and a plurality of at of oscillation step-up circuits for driving the DC-driven lights. The digital control circuit includes a digital switching signal generating circuit and a multiplex feedback-control calculating circuit. The digital switching signal generating circuit connects to each of the oscillation step-up circuits, and generates digital switching signals respectively to the oscillation step-up circuits. The multiplex feedback-control calculating circuit has a control-calculating unit and an A/D converting unit. The control-calculating unit controls the digital switching signal generating circuit, and controls a phase and a duty cycle of each digital switching signal generated by the digital switching signal generating circuit according to digital feedback signals from the A/D converting unit. The A/D converting unit converts feedback signals from the DC-driven light into the digital feedback signals, respectively. The oscillation step-up circuits are controlled according to the digital switching signals, respectively.

Since the digital controlled multi-light driving apparatus of the invention employs just one digital control circuit to control a plurality of oscillation step-up circuits, the conventional current adjusting circuit 81 is omitted and it is not necessary to use the feedback control circuit 84 repeatedly. In other words, the digital controlled multi-light driving apparatus of the invention has a simple structure, resulting in reduced manufacturing cost. Furthermore, the digital controlled multi-light driving apparatus has a digital control circuit for generating sets of digital switching signals, which are phase controllable and duty cycle controllable. The oscillation step-up circuits can be controlled according to the sets of digital switching signals, so that the phases and brightness of different lights can be respectively controlled so as to improve display quality or illumination efficiency.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The digital controlled multi-light driving apparatus according to the preferred embodiments of the invention will be described herein below with reference to the accompanying drawings.

Figure 1:
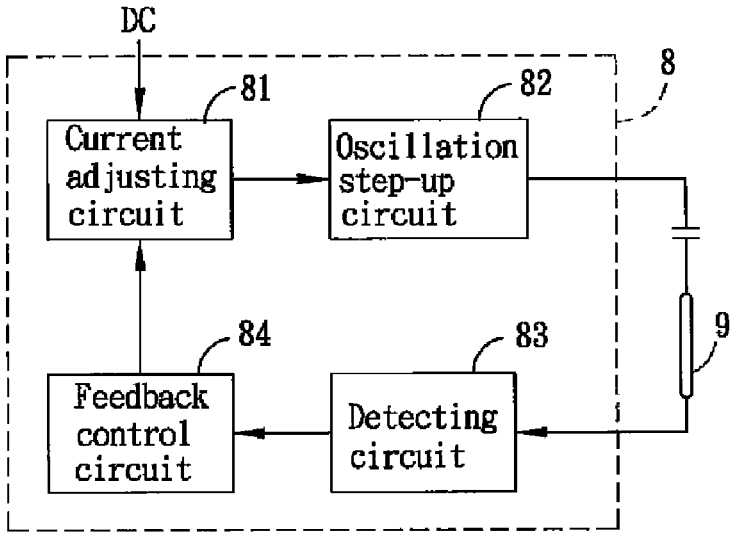
FIG. 1 (Prior Art)
FIG. 1 is a block diagram showing a conventional light driving apparatus.
Figure 2:
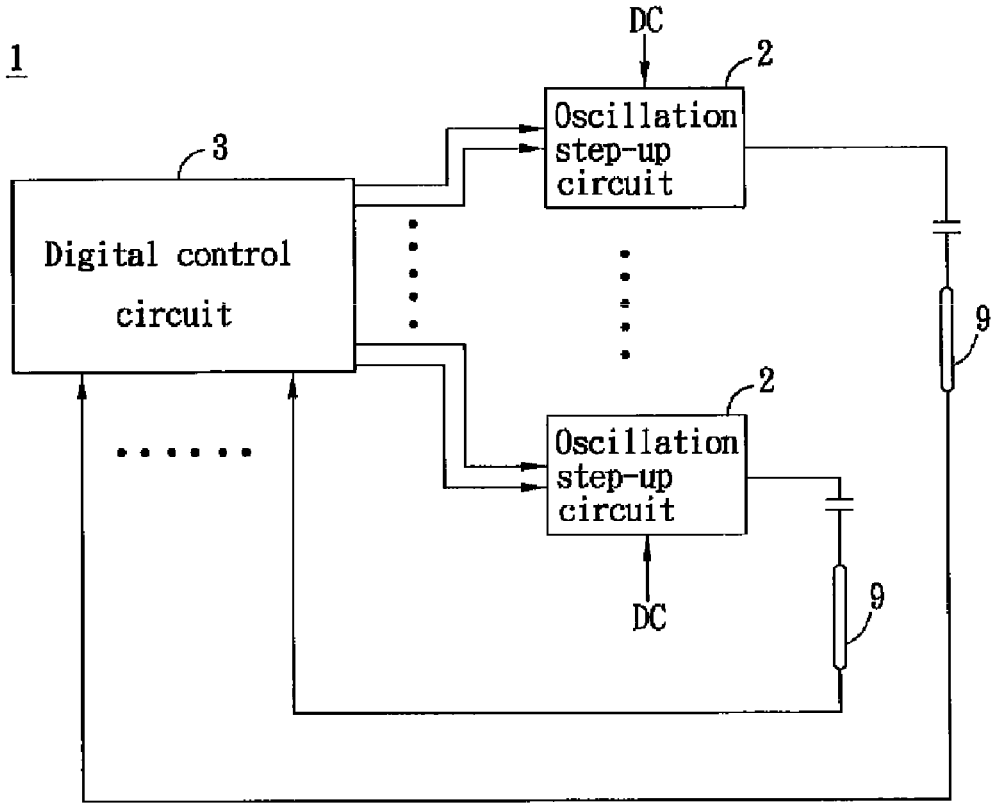
FIG. 2 is a block diagram showing a digital controlled multi-light driving apparatus according to a preferred embodiment of the invention.

Referring to FIG. 2, a digital controlled multi-light driving apparatus 1 includes a plurality of oscillation step-up circuits 2 and a digital control circuit 3.

Figure 3:
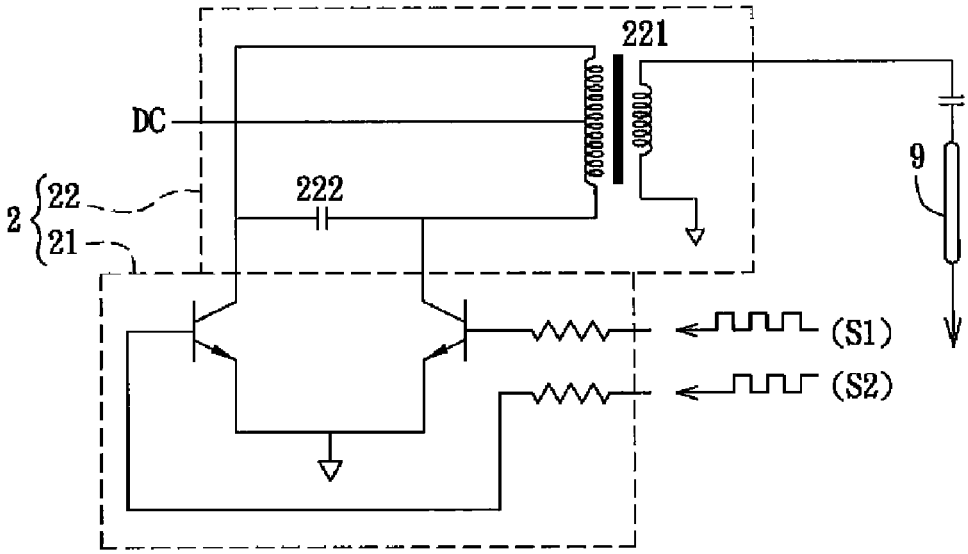
FIG. 3 is a schematic illustration showing an oscillation step-up circuit of the digital controlled multi-light driving apparatus of the invention.

The digital control circuit 3 electrically connects to the oscillation step-up circuits 2, respectively. The digital control circuit 3 further generates sets of digital switching signals S1 and S2 (as shown in FIG. 3), which are phase controllable and duty cycle controllable, and respectively transmits the sets of the digital switching signals S1 and S2 to the oscillation step-up circuits 2. The phase and duty cycle of each set of digital switching signals S1 and S2 are controlled by the digital control circuit 3.

With reference to FIG. 3, each oscillation step-up circuit 2 includes a switching unit 21 and a resonance step-up unit 22. In the present embodiment, the switching unit 21 includes two bipolar transistors and two resistors. One end of each resistor connects to the base electrode of each corresponding bipolar transistor, and the other end of each resistor connects to the digital control circuit 3 for receiving the digital switching signals S1 and S2. The resonance step-up unit 22 mainly consists of a transformer 221 and a capacitor 222. The two ends of the capacitor 222 electrically connect to the collectors of the bipolar transistors, respectively. Moreover, the resonance step-up unit 22 may at least electrically connect to one cold cathode fluorescent lamp (CCFL) 9, which serves as the light. It should be noted that the switching unit 21 may also consist of two MOS transistors (not shown). In this case, the digital switching signals S1 and S2 input from the digital control circuit 3 are used to control the gates of the MOS transistors.

Figure 4:
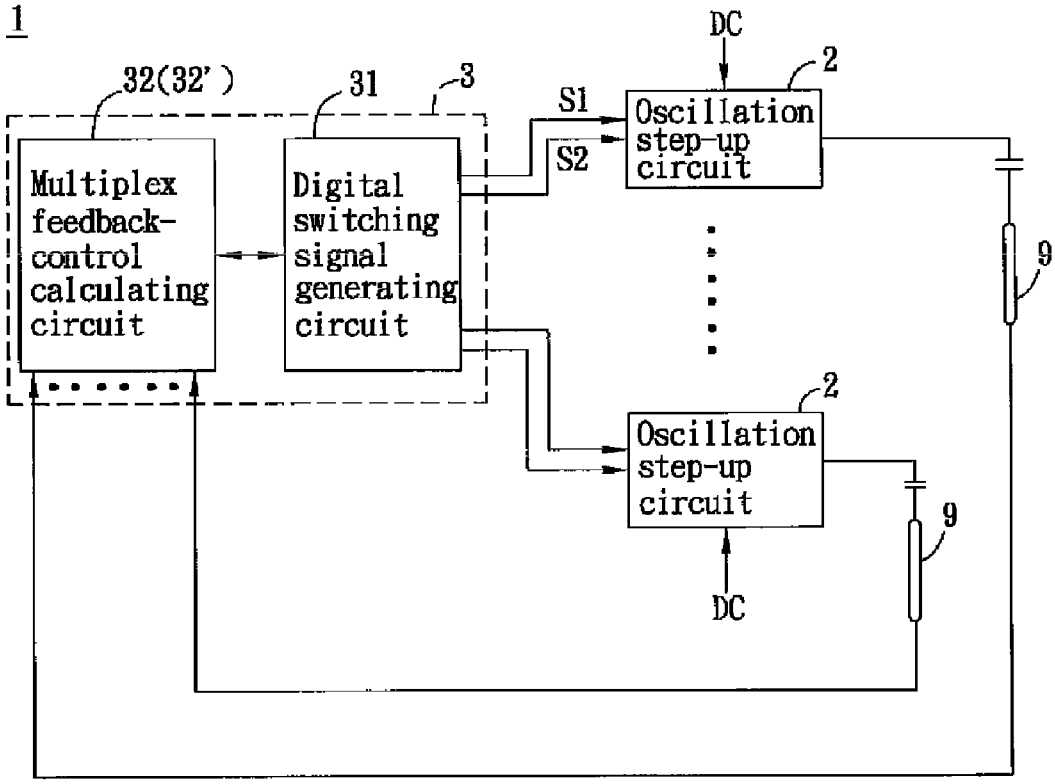
FIG. 4 is a block diagram showing a digital controlled multi-light driving apparatus according to an additional preferred embodiment of the invention.

With reference to FIG. 4, the digital control circuit 3 includes a digital switching signal generating circuit 31 and a multiplex feedback-control calculating circuit 32.

The digital switching signal generating circuit 31 electrically connects to each of the oscillation step-up circuits 2, and generates sets of digital switching signals S1 and S2, wherein the sets of the digital switching signals S1 and S2 are transmitted to the oscillation step-up circuits 2, respectively. The multiplex feedback-control calculating circuit 32 controls the digital switching signal generating circuit 31. The multiplex feedback-control calculating circuit 32 further controls the duty cycles of the sets of digital switching signals S1 and S2 according to the feedback signals of the CCFLs 9. In the current embodiment, the feedback signal of each CCFL 9 can be a current signal or a voltage signal.

Figure 5:
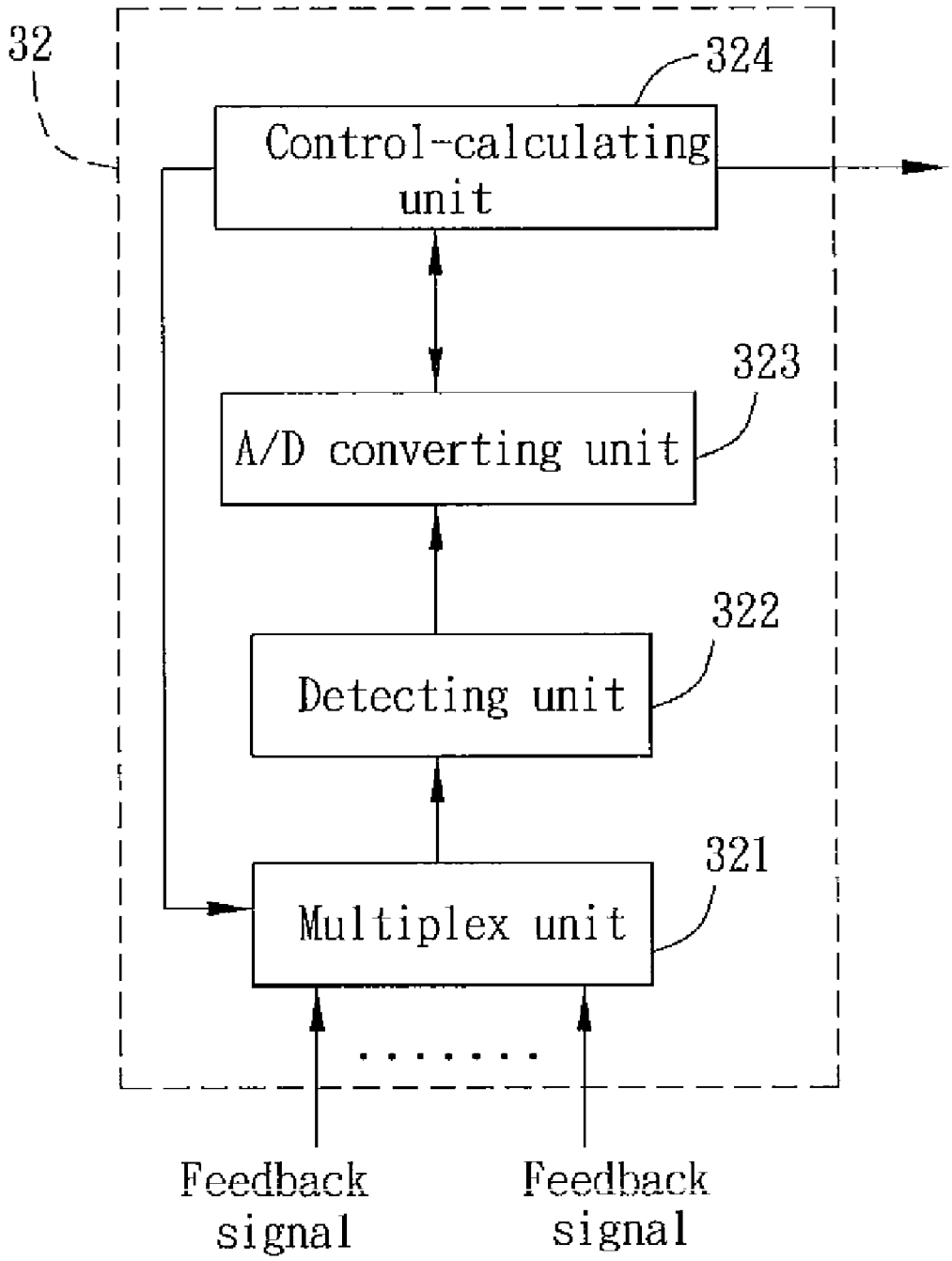
FIG. 5 is a block diagram showing a multiplex feedback-control calculating circuit of the digital controlled multi-light driving apparatus of the invention.

Referring to FIG. 5, the multiplex feedback-control calculating circuit 32 includes a multiplex unit 321 electrically connecting to each of the CCFLs 9 (the lights), a detecting unit 322 for detecting the feedback signals from the CCFLs 9 (the lights), an A/D converting unit 323 to respectively convert the feedback signals into digital feedback signals, and a control-calculating unit 324 to control the digital switching signal generating circuit 31 according to the digital feedback signals. The control-calculating unit 324 further controls the multiplex unit 321, so that the multiplex unit 321 can pick one of the feedback signals to be detected. In practice, the multiplex feedback-control calculating circuit 32 can be a single-chip microprocessor.

Figure 6:
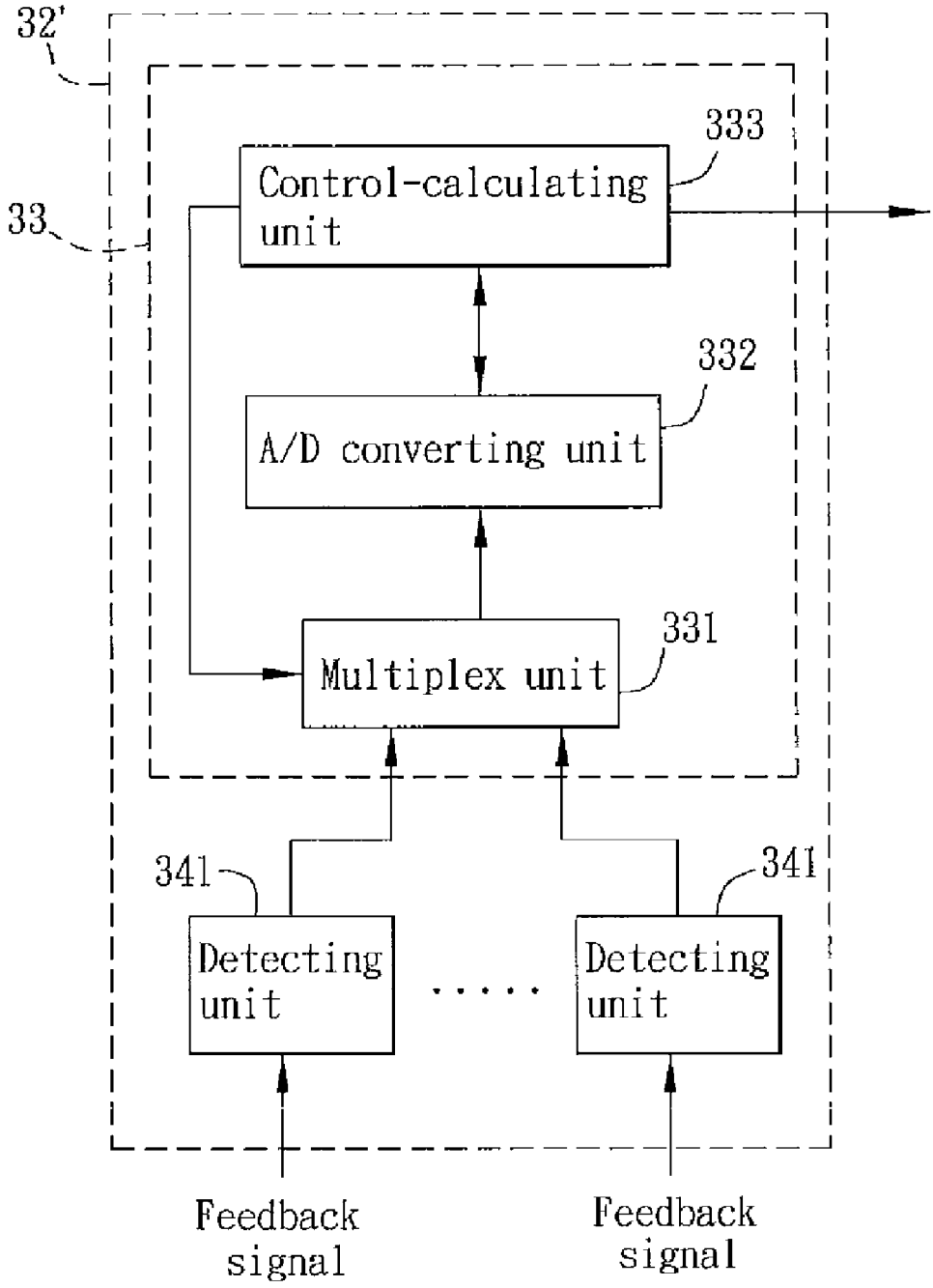
FIG. 6 is a block diagram showing a multiplex feedback-control calculating circuit according to an additional embodiment of the invention.

In an additional embodiment of the invention, the multiplex feedback-control calculating circuit may be implemented as shown in the block diagram of FIG. 6. The multiplex feedback-control calculating circuit 32' includes a single-chip microprocessor 33 and a plurality of detecting units 341. The single-chip microprocessor 33 includes a multiplex unit 331, an A/D converting unit 332, and a control-calculating unit 333. The detecting units 341 are electrically connected to the CCFLs 9 (the lights), respectively, so as to detect the feedback signals from the CCFLs 9.

Figure 7:
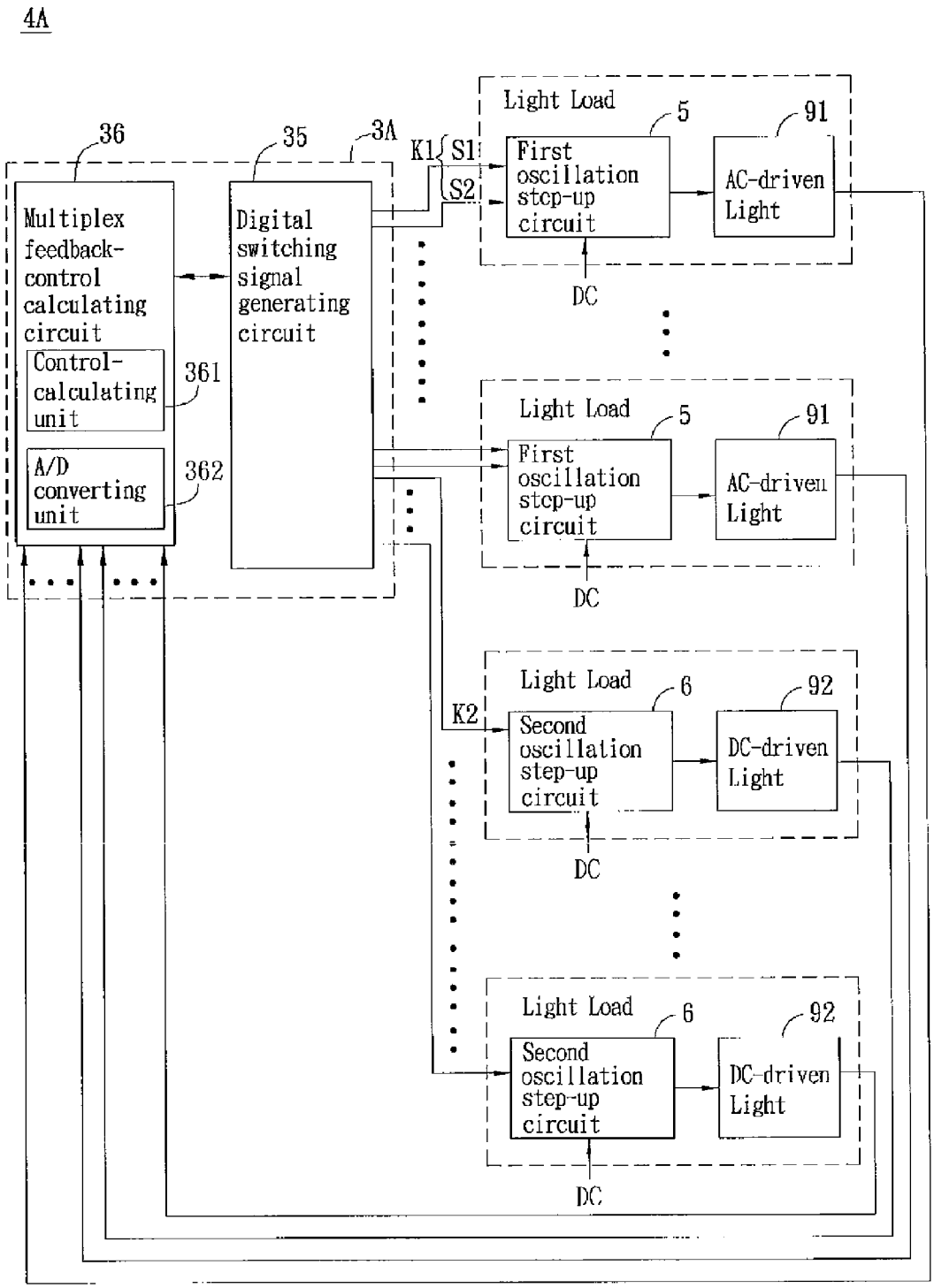
FIG. 7 is a block diagram showing a digital controlled multi-light driving

Referring to FIG. 7, a digital controlled multi-light driving apparatus 4A is for driving and controlling AC-driven lights 91 and DC-driven lights 92. The digital controlled multi-light driving apparatus 4A includes a first oscillation step-up circuit 5 for driving the AC-driven light 91, a second oscillation step-up circuit 6 for driving the DC-driven light 92, and a digital control circuit 3A. The digital control circuit 3A has a digital switching signal generating circuit 35 and a multiplex feedback-control calculating circuit 36.

The digital switching signal generating circuit 35 connects to each of the first oscillation step-up circuit 5 and the second oscillation step-up circuit 6, and generates a first set K1 of digital switching signals S1, S2 and a second digital switching signal K2 respectively to the first oscillation step-up circuit 5 and the second oscillation step-up circuit 6.

The multiplex feedback-control calculating circuit 36 has a control-calculating unit 361 and an A/D converting unit 362. The control-calculating unit 361 controls the digital switching signal generating circuit 35, and controls a phase and a duty cycle of one of the first set K1 of the digital switching signals S1, S2 and the second digital switching signal K2 generated by the digital switching signal generating circuit 35 according to digital feedback signals from the A/D converting unit 362. The A/D converting unit 362 converts feedback signals from the AC-driven light 91 and the DC-driven light 92 into the digital feedback signals, respectively.

In the embodiment, the AC-driven light 91 has a cold cathode fluorescent lamp (CCFL), and the DC-driven light 92 has a light-emitting diode (LED). In addition, the AC-driven light 91 may have a light-emitting diode (LED) or other illumination device driven by AC power. The DC-driven light 92 may have other illumination device driven by DC power.

Figure 8:
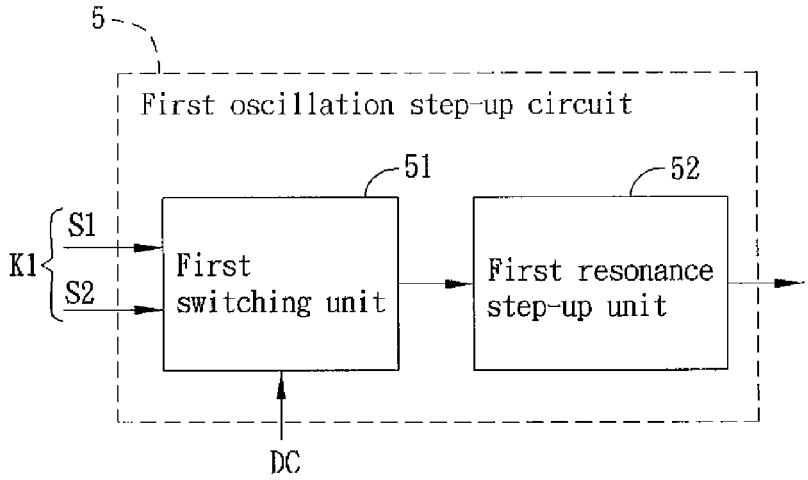
FIG. 8 is a block diagram showing a first oscillation step-up circuit of the digital controlled multi-light driving apparatus of the invention.

Referring to FIG. 8, the first oscillation step-up circuit 5 has a first switching unit 51 and a first resonance step-up unit 52. The first switching unit 51 electrically connects to the digital control circuit 3A and performing switching according to the first set K1 of the digital switching signals S1, S2 output from the digital control circuit 3. The first resonance step-up unit 52 is controlled by the first switching unit 51 and outputs AC power for driving the AC-driven light 91. Since the first switching unit 51 and a first resonance step-up unit 52 are similar to the corresponding one of the above embodiments, they can be modified in the same way. Thus, these elements are not repetitiously discussed or described here.

Figure 9:
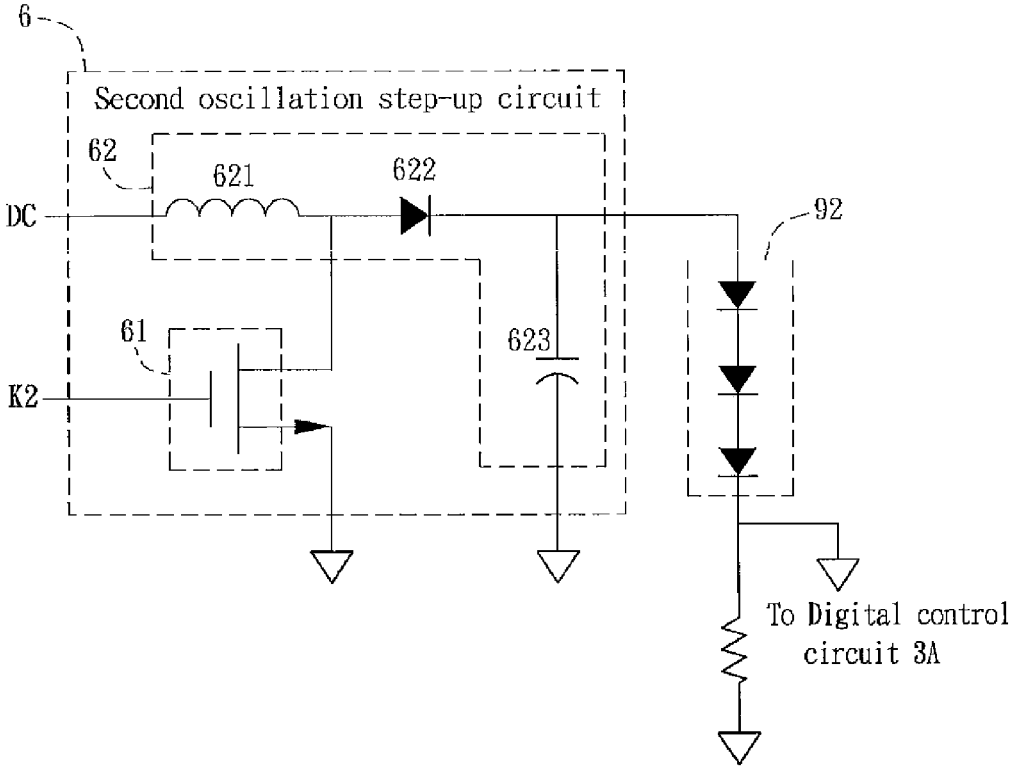
FIG. 9 is a schematic illustration showing a second oscillation step-up circuit of the digital controlled multi-light driving apparatus of the invention.

Referring to FIG. 9, the second oscillation step-up circuit 6 has a second switching unit 61 and a second resonance step-up unit 62. The second switching unit 61 electrically connects to the digital control circuit 3A and performing switching according to the second digital switching signal K2 output from the digital control circuit 3A. The second resonance step-up unit 62 is controlled by the second switching unit 61 and outputs DC power for driving the DC-driven light.

The second resonance step-up unit 62 has an inductor 621, a diode 622 and a capacitor 623. The second switching unit 61 has a transistor 611 electrically connected to the inductor 621. Two end of the diode 622 electrically connect to the transistor 611 and the capacitor 623. The transistor 611 is turned on/off according to the second digital switching signal K2.

In the embodiments, the digital control circuit 3A controls a plurality of light loads. These light loads have at least one AC-driven light 91, at least one DC-driven light 92, at least one first oscillation step-up circuit 5 for driving the AC-driven light 91, and at least one second oscillation step-up circuit 6 for driving the DC-driven light 92. The digital control circuit 3A can controls both of the DC-driven light and the AC-driven light.

Figure 10:
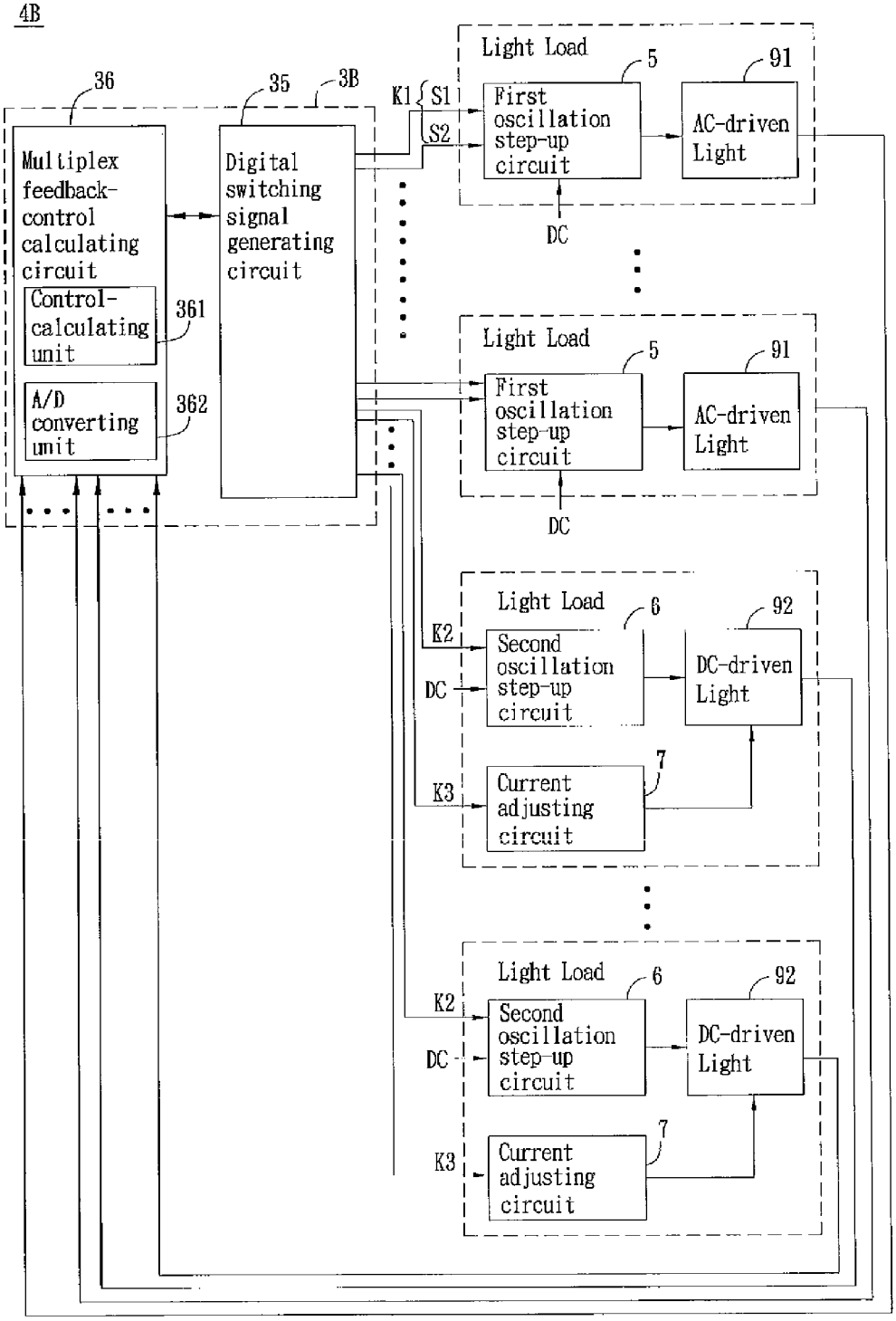
FIG. 10 is a block diagram showing a digital controlled multi-light driving apparatus according to an additional preferred embodiment of the invention.
Figure 11:
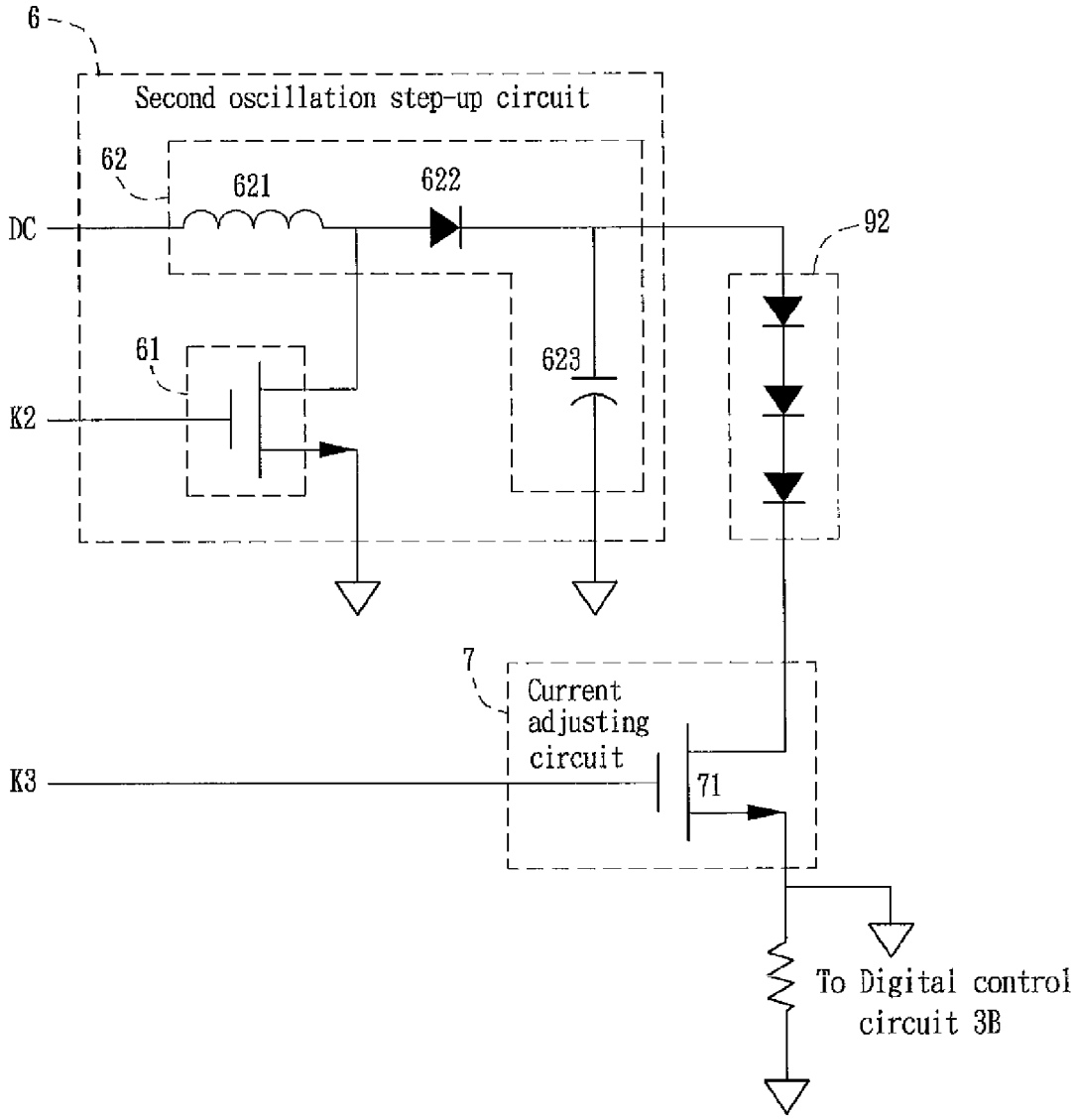
FIG. 11 is a schematic illustration showing a second oscillation step-up circuit and a current adjusting circuit of the digital controlled multi-light driving apparatus of the invention.

Referring to FIG. 10, the difference between FIG. 10 and FIG. 7 is that a digital controlled multi-light driving apparatus 4B further includes a current adjusting circuit 7 connected to the DC-driven light 92. The current adjusting circuit 7 adjusts the current driving the DC-driven light 92 according to a third digital switching signal K3 generated by the digital control circuit 3B. In the embodiment, the current adjusting circuit 7 has a transistor 71 connected to the DC-driven light 92 shown in FIG. 11. Both the driving voltage and the driving current of the DC-driven light can be controlled in digital by the digital control circuit.

Figure 12:
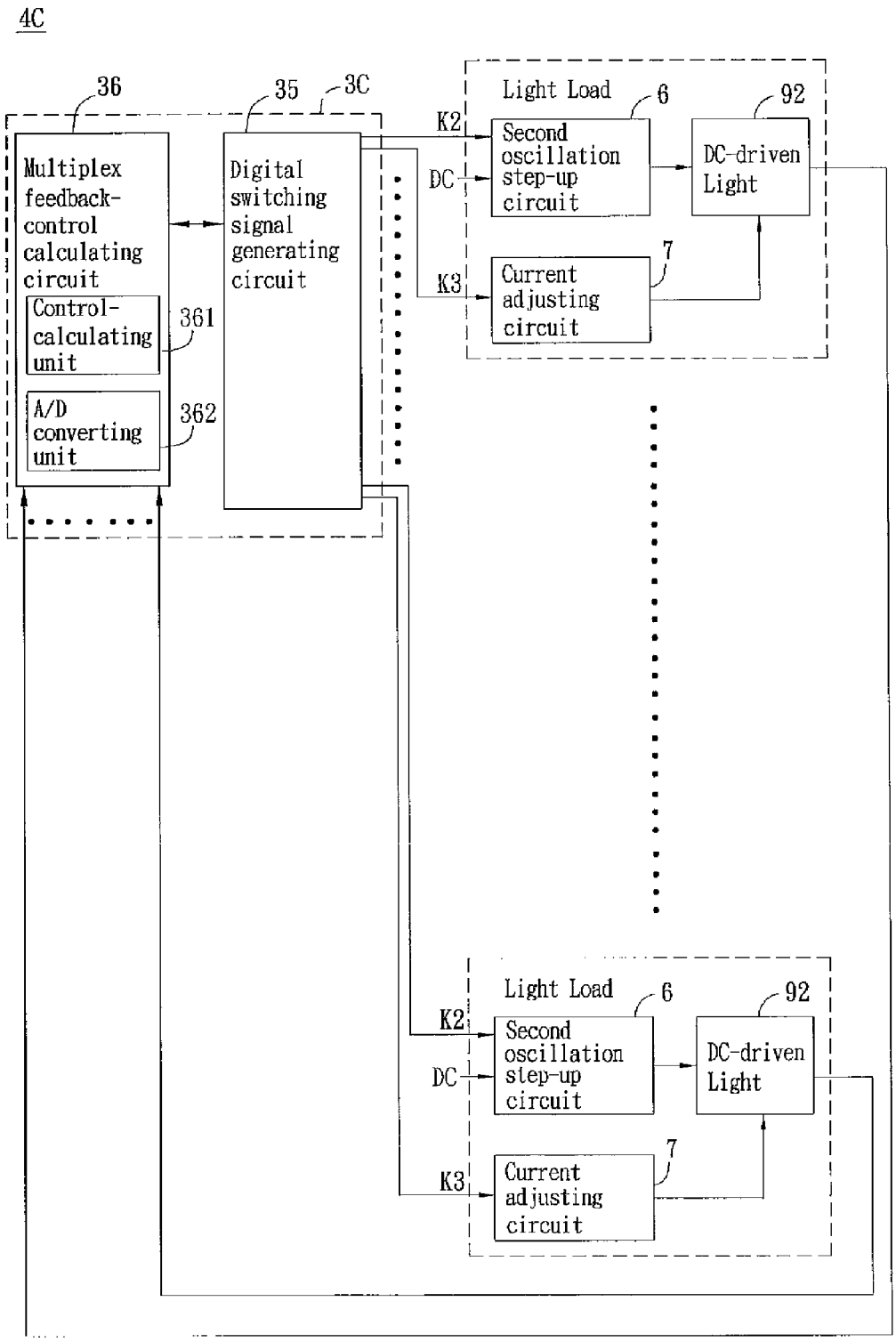
FIG. 12 is a block diagram showing a digital controlled multi-light driving apparatus according to an additional preferred embodiment of the invention.

Referring to FIG. 12, the difference between FIG. 12 and FIG. 10 is that a digital controlled multi-light driving apparatus 4C is for driving and controlling DC-driven lights. Since the elements of the digital controlled multi-light driving apparatus 4C is similar to the corresponding one of the above embodiments, they can be modified in the same way. Thus, these elements are not repetitiously discussed or described here.

In the embodiment, the digital control circuit 3C controls a plurality of light loads having a plurality of DC-driven lights and a plurality of at of oscillation step-up circuits for driving the DC-driven lights.

In summary, since the digital controlled multi-light driving apparatus of the invention only employs one digital control circuit to control a plurality of oscillation step-up circuits, the conventional current adjusting circuit 81 is unnecessary and omitted. Furthermore, the conventional feedback control circuit 84 is not repeatedly used. In other words, the digital controlled multi-light driving apparatus of the invention has a simple structure, and therefore is less costly to manufacture. Moreover, the digital controlled multi-light driving apparatus has a digital control circuit for generating sets of digital switching signals, which are phase controllable and duty cycle controllable. The oscillation step-up circuits can be controlled according to the sets of digital switching signals, so that the phases and brightness of different lights can be respectively controlled to improve the display quality of an LCD or illumination efficiency.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A digital controlled multi-light driving apparatus for driving and controlling at least one AC-driven light and at least one DC-driven light, comprising:

at least one first oscillation step-up circuit for driving the AC-driven light;

at least one second oscillation step-up circuit for driving the DC-driven light; and a digital control circuit, which has a digital switching signal generating circuit and a multiplex feedback-control calculating circuit, the digital switching signal generating circuit connects to each of the first oscillation step-up circuit and the second oscillation step-up circuit, and generates a first set of digital switching signals and a second digital switching signal respectively to the first oscillation step-up circuit and the second oscillation step-up circuit, wherein the multiplex feedback-control calculating circuit has a control-calculating unit and an A/D converting unit, the control-calculating unit controls the digital switching signal generating circuit, and controls a phase and a duty cycle of one of the first set of the digital switching signals and the second digital switching signal generated by the digital switching signal generating circuit according to digital feedback signals from the A/D converting unit, the A/D converting unit converts feedback signals from the AC-driven light and the DC-driven light into the digital feedback signals, respectively, wherein the first oscillation step-up circuit and the second oscillation step-up circuit are controlled according to the first set of digital switching signals and the second digital switching signal, respectively.

2. The driving apparatus of claim 1, wherein the AC-driven light has a cold cathode fluorescent lamp (CCFL), and the DC-driven light has a light-emitting diode (LED).

3. The driving apparatus of claim 1, wherein the first oscillation step-up circuit comprises:

a first switching unit, electrically connected to the digital control circuit and performing switching according to the first set of the digital switching signals output from the digital control circuit; and a first resonance step-up unit, controlled by the first switching unit and outputting AC power for driving the AC-driven light, wherein the second oscillation step-up circuit comprises:

a second switching unit, electrically connected to the digital control circuit and performing switching according to the second digital switching signal output from the digital control circuit; and a second resonance step-up unit, controlled by the second switching unit and outputting DC power for driving the DC-driven light.

4. The driving apparatus of claim 3, wherein the first resonance step-up unit comprises a transformer and a capacitor, the first switching unit comprises two transistors, the transistors electrically connect to the two ends of the capacitor, respectively, and the transistors are turned on/off according to the first set of the digital switching signals.

5. The driving apparatus of claim 4, wherein the first switching unit further comprises two resistors, one end of each of the resistors electrically connects to the base electrode of each corresponding transistor, respectively, and the other end of each of the resistors electrically connects to the digital control circuit.

6. The driving apparatus of claim 3, wherein the second resonance step-up unit comprises an inductor, a diode and a capacitor, the second switching unit comprises a transistor, the transistor electrically connects to the inductor, two end of the diode electrically connect to the transistor and the capacitor, and the transistor is turned on/off according to the second digital switching signal.

7. The driving apparatus of claim 1, comprising:

a current adjusting circuit, connected to the DC-driven light and adjusting the current driving the DC-driven light according to a third digital switching signal generated by the digital control circuit.

8. The driving apparatus of claim 1, wherein the multiplex feedback-control calculating circuit is a digital single-chip microprocessor.

9. The driving apparatus of claim 1, wherein the multiplex feedback-control calculating circuit comprises:

a multiplex unit, which electrically connects to each of the AC-driven light and the DC-driven light; and a detecting unit, which electrically connects to the multiplex unit to detect the feedback signals from the AC-driven light and the DC-driven light, wherein the A/D converting unit converts the feedback signals into digital feedback signals, respectively, and the control-calculating unit controls the multiplex unit, and further controls the digital switching signal generating circuit according to the digital feedback signals.

10. The driving apparatus of claim 1, wherein the multiplex feedback-control calculating circuit comprises:

a plurality of detecting units, which electrically connect to the AC-driven light and the DC-driven light and detect the feedback signals respectively input from the AC-driven light and the DC-driven light; and a multiplex unit, which electrically connects to each of the detecting units, wherein the A/D converting unit electrically connects to the multiplex unit and converts the feedback signals into digital feedback signals, respectively, and the control-calculating unit controls the multiplex unit, and further controls the digital switching signal generating circuit according to the digital feedback signals.

11. The driving apparatus of claim 10, wherein the multiplex unit, the A/D converting unit, the control-calculating unit are integrated in a digital single-chip microprocessor.

12. The driving apparatus of claim 10, wherein the A/D converting unit, the control-calculating unit are integrated in a digital single-chip microprocessor.

13. A digital controlled multi-light driving apparatus for driving and controlling a plurality of DC-driven lights, comprising:

a plurality of at of oscillation step-up circuits for driving the DC-driven lights; and a digital control circuit, which has a digital switching signal generating circuit and a multiplex feedback-control calculating circuit, the digital switching signal generating circuit connects to each of the oscillation step-up circuits, and generates digital switching signals respectively to the DC oscillation step-up circuits, wherein the multiplex feedback-control calculating circuit has a control-calculating unit and an A/D converting unit, the control-calculating unit controls the digital switching signal generating circuit, and controls a phase and a duty cycle of each digital switching signals generated by the digital switching signal generating circuit according to digital feedback signals from the A/D converting unit, the A/D converting unit converts feedback signals from the DC-driven light into the digital feedback signals, respectively, wherein the oscillation step-up circuits are controlled according to the digital switching signals, respectively.

14. The driving apparatus of claim 13, wherein one of the DC-driven lights a light-emitting diode (LED).

15. The driving apparatus of claim 13, wherein one of the oscillation step-up circuit comprises:

a switching unit, electrically connected to the digital control circuit and performing switching according to a corresponding one of the digital switching signals output from the digital control circuit; and a resonance step-up unit, controlled by the switching unit and outputting DC power for driving the DC-driven light.

16. The driving apparatus of claim 15, wherein the resonance step-up unit comprises an inductor, a diode and a capacitor, the switching unit comprises a transistor, the transistor electrically connects to the inductor, two end of the diode electrically connect to the transistor and the capacitor, and the transistor is turned on/off according to the corresponding one of the digital switching signals.

17. The driving apparatus of claim 13, comprising:

a current adjusting circuit, connected to the DC-driven light and adjusting the current driving the DC-driven light according to a current-control digital switching signal generated by the digital switching signal generating circuit.

18. The driving apparatus of claim 13, wherein the multiplex feedback-control calculating circuit is a digital single-chip microprocessor.

19. The driving apparatus of claim 13, wherein the multiplex feedback-control calculating circuit comprises:

a multiplex unit, which electrically connects to each of the DC-driven light and the AC-driven light; and a detecting unit, which electrically connects to the multiplex unit to detect the feedback signals from the DC-driven light and the AC-driven light, wherein the A/D converting unit converts the feedback signals into digital feedback signals, respectively, and the control-calculating unit controls the multiplex unit, and further controls the digital switching signal generating circuit according to the digital feedback signals.

20. The driving apparatus of claim 13, wherein the multiplex feedback-control calculating circuit comprises:

a plurality of detecting units, which electrically connect to the DC-driven light and the AC-driven light and detect the feedback signals respectively input from the DC-driven light and the AC-driven light; and a multiplex unit, which electrically connects to each of the detecting units, wherein the A/D converting unit electrically connects to the multiplex unit and converts the feedback signals into digital feedback signals, respectively, and the control-calculating unit controls the multiplex unit, and further controls the digital switching signal generating circuit according to the digital feedback signals.

21. The driving apparatus of claim 20, wherein the multiplex unit, the A/D converting unit, the control-calculating unit are integrated in a digital single-chip microprocessor.

22. The driving apparatus of claim 20, wherein the A/D converting unit, the control-calculating unit are integrated in a digital single-chip microprocessor.

23. A digital control circuit for controlling a plurality of light loads, wherein the light loads have at least one AC-driven light, at least one DC-driven light, at least one first oscillation step-up circuit for driving the AC-driven light, and at least one second oscillation step-up circuit for driving the DC-driven light, the digital control circuit comprising:

a digital switching signal generating circuit, connected to each of the first oscillation step-up circuit and the second oscillation step-up circuit, and generating a first set of digital switching signals and a second digital switching signal respectively to the first oscillation step-up circuit and the second oscillation step-up circuit; and a multiplex feedback-control calculating circuit, having a control-calculating unit and an A/D converting unit, wherein the control-calculating unit controls the digital switching signal generating circuit, and controls a phase and a duty cycle of one of the first set of the digital switching signals and the second digital switching signal generated by the digital switching signal generating circuit according to digital feedback signals from the A/D converting unit, the A/D converting unit converts feedback signals from the AC-driven light and the DC-driven light into the digital feedback signals, respectively, wherein the first oscillation step-up circuit and the second oscillation step-up circuit are controlled according to the first set of digital switching signals and the second digital switching signal, respectively.

24. A digital control circuit for controlling a plurality of light loads, wherein the light loads have a plurality of DC-driven lights and a plurality of at of oscillation step-up circuits for driving the DC-driven lights, the digital control circuit comprising:

a digital switching signal generating circuit, connected to each of the oscillation step-up circuits, and generating digital switching signals respectively to the oscillation step-up circuits, and a multiplex feedback-control calculating circuit, having a control-calculating unit and an A/D converting unit, wherein the control-calculating unit controls the digital switching signal generating circuit, and controls a phase and a duty cycle of each digital switching signal generated by the digital switching signal generating circuit according to digital feedback signals from the A/D converting unit, the A/D converting unit converts feedback signals from the DC-driven light into the digital feedback signals, respectively, wherein the oscillation step-up circuits are controlled according to the digital switching signals, respectively.

* * * * *